US005980651A

United States Patent [19]

de Azevedo et al.

[11] Patent Number: 5,980,651

[45] Date of Patent: Nov. 9, 1999

[54] PROCESS TO OBTAIN PARTS OF HIGH CARBON GRAY CAST IRON AND HIGH CARBON GRAY CAST IRON MATERIAL IN SPECIAL TO MANUFACTURE ROTORS AND DRUM BRAKE SYSTEMS AND GENERAL AUTOMOTIVE APPLICATION WITH NOISE ABSORPTION

[76] Inventors: Altemicio Rodrigues de Azevedo, Rua Rubens Janini, 12; Oswaldo Cruz, Rua Mario Pizani, 36, both of Sao Paulo, Brazil

[21] Appl. No.: 08/759,413

[22] Filed: Dec. 4, 1996

[30] Foreign Application Priority Data

Dec. 4, 1995 [BR] Brazil ..... 9505347

[51] Int. Cl.[6] ..... C22C 37/06

[52] U.S. Cl. ..... 148/321; 420/26

[58] Field of Search ..... 420/26, 33; 148/321

[56] References Cited

FOREIGN PATENT DOCUMENTS

| | | | |
|---|---|---|---|
| 39921 | 4/1978 | Japan | 420/26 |
| 985121 | 1/1982 | Russian Federation | 420/26 |
| 495819 | 11/1937 | United Kingdom | 420/26 |

*Primary Examiner*—Deborah Yee

[57] ABSTRACT

A method to obtain parts of high carbon gray cast iron and high carbon gray cast iron material includes, a process to obtain high carbon gray cast iron and high carbon gray cast iron castings parts from the material. The castings parts so obtained are casting parts, which undergo friction, such as brake rotors and drums used in general automotive vehicles, clutch discs and/or other types of castings whose main characteristics are noise absorption properties caused by friction, and increased reduction of thermal cracks and fissures on the surface as a result of the action of friction.

2 Claims, 1 Drawing Sheet

PROCESS TO OBTAIN PARTS OF HIGH CARBON GRAY CAST IRON AND HIGH CARBON GRAY CAST IRON MATERIAL IN SPECIAL TO MANUFACTURE ROTORS AND DRUM BRAKE SYSTEMS AND GENERAL AUTOMOTIVE APPLICATION WITH NOISE ABSORPTION

FIELD OF THE INVENTION

The present invention relates to a new process to obtain high carbon cast iron and parts obtained from such material. The present invention is directed mainly to those castings parts which undergo severe friction, such as brake rotors and drums, used in brake systems for general automotive applications, clutch discs and/or parts whose main characteristics include the properties of noise damping from friction action, and the considerable reduction of thermal cracks and fissures on the surface resulting from the friction action.

BACKGROUND OF THE INVENTION

The gray cast iron used in the manufacturing of ordinary castings parts has a tolerance in its morphology of graphite veins sized from 5 to 8 (wherein the size is determined by the thickness×length in the gray cast iron material morphology). Such veins result in fine flakes in the structure of the material, providing for increased hardness and resistance within the known standards of specification for castings parts of gray cast iron, specially for rotors and brake drums.

The graphite presentation in the material morphology of the gray cast iron within conventional standards allows the occurrence of graphite veins of types "A" and "B" and occasionally of types "D" and "E".

For example, the graphite veins known for their shape in the material morphology of gray cast iron are type "A"—being irregular disorientated; "B", —being rosette; "C"—being irregular uneven; "D"—being disorientated interdendritic and type "E"—being right interdendritic.

To obtain regular or ordinary castings parts, it is not acceptable, except in meaningless proportions, to have the presence of type "C" graphite veins in the morphology of the gray cast iron, as such morphology produces a less resistant gray cast iron due to its brittleness in structure and in its reduced hardness, which is considered to be of a poor quality.

The gray cast iron is used in the manufacturing of general friction castings parts, specially brake rotors, clutch and brake drums. Besides the ordinary constituent components pertinent to gray cast iron, it also presents the necessary constituent components relevant to its composition, such as copper, manganese, chromium and silicon, in a wide variable ranges of concentration, and it can also present sulfur concentration in restrictive variable ranges.

OBJECTS OF THE INVENTION

It is therefore an object of the present invention to produce a process to obtain parts of high carbon gray cast iron and high gray cast iron material, thereunder, which process includes the steps of obtaining castings and gray cast iron alloy which are, noise absorbers and are resistant to thermal cracks caused by friction during the parts' useful life, having hardness and resistance within the quality standards of recognized international specifications.

SUMMARY OF THE INVENTION

In keeping with this object and others which may become apparent, the present invention concerns a process to obtain parts of high carbon gray cast iron and high carbon gray cast iron material. The process obtains high carbon gray cast iron and high carbon gray cast iron castings parts from the material. The material is used in castings parts, which parts normally undergo friction, such as brake rotors and drums used in general automotive vehicles, clutch discs and/or other types of castings, whose main characteristics are noise absorption properties caused by friction, and increased reduction of thermal cracks and fissures on the surface, as a result of the action of friction.

DESCRIPTION OF THE DRAWINGS

The present invention can best be understood in connection with the accompanying drawings, in which.

DESCRIPTION OF THE PREFERRED EMBODIMENT

Figure 1:
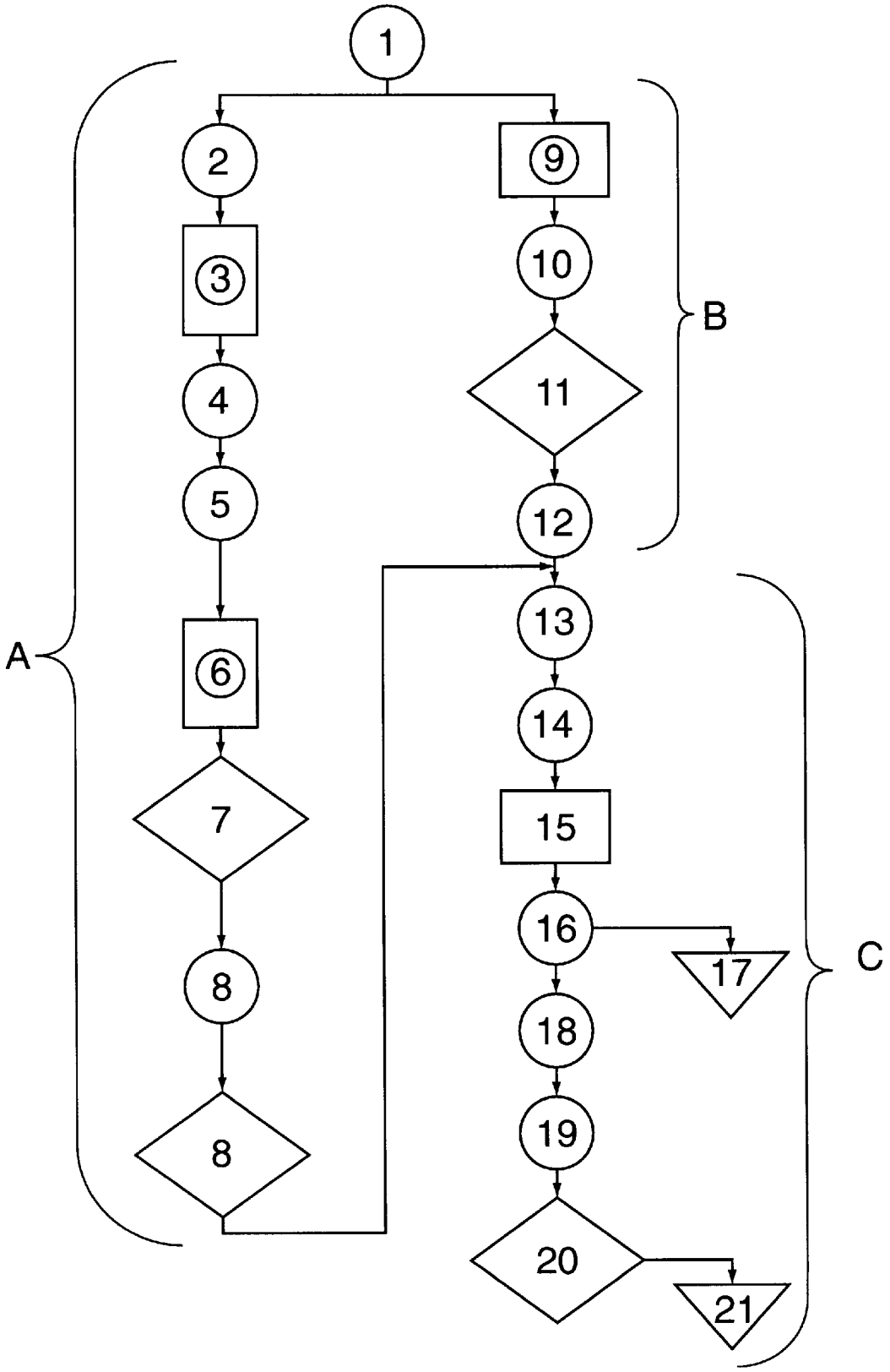
FIG. 1 shows a flow chart of an embodiment for the steps for obtaining high carbon gray cast iron and castings parts therefrom.

The gray cast iron presently employed, comprises graphite veins sized from 5 to 8 and an alloy composition in the following proportions: carbon 3.05 to 3.30%; silicon 2.05 to 2.30%; copper 0.50 to 1.00%; manganese 0.50 to 1.00%; phosphorus 0.00 to 0.12% and sulfur 0.00 to 0.12%.

The high carbon gray cast iron, with its damping capacity, is obtained by changing the size of the graphite vein in the material morphology to a tolerance of size from 3 to 6, wherein thus forming a thicker flake, that changes the morphology of the gray cast iron in relation to the iron usually employed, so as to obtain gray cast iron of high thermal conductivity, which provides for high fluidity through the casting. This prevents over heating and promotes a lower final temperature after the action of friction. The gray cast iron also has hardness and mechanical resistance to prevent breaks, fissures and cracks in the casting parts made with the gray cast iron.

To obtain the high carbon gray cast iron, the carbon concentration is increased, by maintaining a chemical composition in the following proportions: carbon equivalent 4.20 to 4.56%; carbon 3.55 to 3.70%, silicon 2.20 to 2.60%; copper 0.20 to 1.00%, manganese 0.20 to 1.00%, tin 0.00 to 0.30%, molybdenum 0.00 to 0.70% sulfur 0.00 to 0.12%; phosphorus 0.00 to 0.12% and chromium 0.00 to 0.35%, where the carbon equivalent is calculated as the percentage of carbon plus one third of the percentage of silicon, less one third of the percentage of chromium, less 0.10.

The microstructure of the material obtained conforms to that indicated in ASTM A 247, having the graphite presenting a whole morphology as follows: predominantly type "A", type "B" not exceeding 40%, type "C" not exceeding 5% and both types "D" and "E" not exceeding 15%. The material so obtained includes such a proportion of a graphite vein sized from 3 to 6. Therefore, there is obtained a fine lamellar pearlitic matrix, with 5% maximum of ferrite and/or 1% of carbides and a gray cast iron with a hardness of 179 to 241 HB and a minimum resistance of 25,000 psi (176 Mpa).

To obtain castings of high carbon gray cast iron the following process is employed according to the illustration in FIG. 1. In parallel there is shown the formation of the high carbon gray cast iron as in a subprocess designated as reference letter (A), a parallel subprocess for the sand preparation in a process designated as reference letter (B) and the pattern for the casting of high carbon gray cast iron in the subprocess designated as reference letter (C) wherein the whole process is electronically controlled.

The steps of the process include the following steps as represented by the reference numbers shown in FIG. 1. Steps 1 through 8 represent the subprocess (A) for forming the high carbon gray cast iron.

Step 1 represents the introduction of incoming raw material.
Step 2 represents calculation of material load.
Step 3 represents loading weight.
Step 4 represents bucket loading.
Step 5 represents melting furnace loading.
Step 6 represents melting.
Step 7 represents temperature measuring and measurement of the chemical composition.
Step 8 represents a further temperature measuring and a further measuring of chemical composition.
Steps 9 through 12 represent the subprocess (B) for said preparation for the cast.
Step 9 represents the step of molding the sand used.
Step 10 represents preparation of foundry of sand.
Step 11 represents analysis of properties of the sand cast.
Step 12 represents molding a mold.
Steps 13 through 21 represent the subprocess (C) for casting of the high carbon gray cast iron into a casting part.
Step 13 represents pouring a cast.
Step 14 represents cooling.
Step 15 represents sampling.
Step 16 represents dismounting or stripping.
Step 17 represents sand recycling.
Step 18 represents stripping and runner breaking.
Step 19 represents cleaning.
Step 20 represents final inspections of the high carbon gray cast iron castings parts.
Step 21 represents shipping of the high carbon gray cast iron casting parts.

As described above is a process to obtain parts of high carbon gray cast iron and high carbon gray iron material, specially used in friction parts, such as brake rotors, brake drums and clutch discs and/or other parts with noise absorption properties, having a resistance to thermal cracks caused by friction during the part useful life, wherein the friction parts have a strength and hardness within recognized quality standards of international specifications.

The castings produced in compliance with this process and materials, may have either a special or an ordinary finish, depending on each application, and may provide for increased wear resistance to friction in the beginning and during the casting part's useful life.

Thus, according to the above noted description, it can be noted that the process to obtain parts of high carbon gray cast iron and high carbon gray cast iron material, concerns a process to obtain castings and the related material, wherein the process involves a new manufacturing process and the obtaining of a novel material therefrom.

It is further noted that other modifications may be made to the present invention without departing from the scope of the invention, as noted in the appended claim.

We claim:

1. A Process to obtain parts of high carbon gray cast iron and high carbon gray cast iron material comprising the following steps:

1. Introducing raw materials;
2. calculating material load;
3. loading weight;
4. bucket loading;
5. melting furnace loading;
6. melting;
7. measuring of temperature and chemical composition;
8. repeat measuring of temperature and chemical composition;
9. molding a sand composition;
10. preparing the foundry sand;
11. analyzing the properties of the cast;
12. molding the mold composition;
13. pouring the cast;
14. cooling;
15. sampling;
16. dismounting or stripping;
17. sand recycling;
18. runner break;
19. cleaning; and
20. final inspection of high carbon gray castings, where the high carbon gray cast iron material comprises weight percentages as follows:

A Carbon equivalent weight percentage of 4.20 to 4.56%;
a Carbon weight percentage of 3.55 to 3.70%;
a Silicon weight percentage of 2.20 to 2.60%;
a Copper weight percentage of 0.20 to 1.00%;
a Manganese weight percentage of 0.20 to 1.00%;
a Tin weight percentage of 0.00 to 0.30%;
a Molybdenum weight percentage of 0.00 to 0.70%;
a Sulfur weight percentage of 0.00 to 0.12%;
a Phosphorus weight percentage of 0.00 to 0.12%; and
a Chromium weight percentage of 0.00 to 0.35%;

said Carbon Equivalent weight percentage is calculated as being the percentage of Carbon plus one third of the percentage of Silicon, less one third of the percentage of Chromium, less 0.10%, wherein said high carbon gray cast iron material presents a microstructure in conformance with the microstructure of graphite in iron castings as described in the American Society for Testing and Materials report dated 1990 entitled, "Standard Test Method for Evaluating the Microstructure of Graphite in Iron Castings" and designated as ASTM A 247, said high carbon gray cast iron material having a graphite with the morphology as being:

type "A"—irregular disoriented—dominant,
type "B"—rosette—not exceeding 40% by volume,
type "C"—irregular uneven—not exceeding 5% by volume, and
both types "D"—disoriented interdendritic—and type "E"—right interdendritic—not exceeding 15% by volume, thus obtaining a graphite containing a vein ASTM-AFS size classification of between 3 to 6 and a fine pearlitic lamellar matrix, with no more than 5% by volume of ferrite and 1% by volume of carbide, and providing for gray cast iron with a hardness of between 179 and 241 HB and a minimum resistance of 25,000 psi (176 Mpa) with the process electronically controlled, obtaining a material of high thermal conductivity, and increased hardness and mechanical resistance to traction.

2. A high carbon gray cast iron and high carbon gray cast iron composition containing a fine pearlitic lamellar matrix with no more than 5% by volume of ferrite and no more than 1% by volume of carbide and comprising weight percentages as follows:

A Carbon equivalent weight percentage of 4.20 to 4.56%;
a Carbon weight percentage of 3.55 to 3.70%;

a Silicon weight percentage of 2.20 to 2.60%;

a Copper weight percentage of 0.20 to 1.00%;

a Manganese weight percentage of 0.20 to 1.00%;

a Tin weight percentage of 0.00 to 0.30%;

a Molybdenum weight percentage of 0.00 to 0.70%;

a Sulfur weight percentage of 0.00 to 0.12%;

a Phosphorus weight percentage of 0.00 to 0.12%; and a Chromium weight percentage of 0.00 to 0.35%;

said Carbon Equivalent weight percentage is calculated as being the percentage of Carbon plus one third of the percentage of Silicon, less one third of the percentage of Chromium, less 0.10%.

* * * * *